US007871077B2

(12) United States Patent
Calvert

(10) Patent No.: US 7,871,077 B2
(45) Date of Patent: Jan. 18, 2011

(54) SYSTEM AND METHOD FOR PLAYING A DICE GAME APPROXIMATING A CARD GAME

(76) Inventor: Carmelyn Calvert, R.R. 1, Box 53A, Eldred, IL (US) 62027

( * ) Notice: Subject to any disclaimer, the term of this patent is extended or adjusted under 35 U.S.C. 154(b) by 93 days.

(21) Appl. No.: 12/290,413

(22) Filed: Oct. 30, 2008

(65) Prior Publication Data

US 2010/0109239 A1 May 6, 2010

(51) Int. Cl.
*A63F 9/04* (2006.01)
*A63F 1/00* (2006.01)

(52) U.S. Cl. ..... 273/146; 273/292

(58) Field of Classification Search ..... 273/146, 273/292; 463/13

See application file for complete search history.

(56) References Cited

U.S. PATENT DOCUMENTS

| | | | | |
|---|---|---|---|---|
| 4,258,919 | A * | 3/1981 | Martelli | 273/146 |
| 5,125,660 | A * | 6/1992 | Stahl | 273/146 |
| 5,415,412 | A * | 5/1995 | McMahon | 273/244 |
| 5,791,649 | A * | 8/1998 | DiSandro | 273/243 |
| 2007/0052174 | A1 * | 3/2007 | Dargue | 273/292 |

* cited by examiner

*Primary Examiner*—Benjamin H Layno
(74) *Attorney, Agent, or Firm*—Mark Manley

(57) ABSTRACT

In certain embodiments, the present invention relates to poker dice and methods of gameplay using poker dice that (i) allows game participants to roll all of the common poker hands (high card, pair, two pair, three of a kind, straight, flush, full house, four of a kind, straight flush, royal flush), in an efficient manner, (ii) enhances the gameplay of the poker-related dice game by using six-sided dice, and (iii) enhances the gameplay of the poker-related dice game by allowing wildcards to be incorporated into the poker dice.

12 Claims, 2 Drawing Sheets

| | | | | | | |
|---|---|---|---|---|---|---|
| A ♦ | 3 ♠ | 4 ♥ | 5 ♣ | 6 ♦ | J ♠ | Dice Number 1 |
| A ♠ | 4 ♦ | 3 ♣ | 9 ♦ | 6 ♠ | J ♥ | Dice Number 2 |
| A ♥ | 4 ♠ | 7 ♥ | 6 ♣ | 8 ♦ | JOKER | Dice Number 3 |
| A ♣ | 3 ♥ | 7 ♠ | 5 ♦ | 9 ♣ | J ♦ | Dice Number 4 |
| K ♦ | 2 ♠ | 4 ♣ | 9 ♠ | 10 ♣ | Q ♥ | Dice Number 5 |
| K ♣ | Q ♠ | 9 ♥ | 7 ♣ | 5 ♠ | 3 ♦ | Dice Number 6 |
| K ♥ | 2 ♥ | 10 ♠ | 8 ♥ | 7 ♦ | J ♣ | Dice Number 7 |
| K ♠ | Q ♦ | 10 ♥ | 8 ♣ | 5 ♥ | 2 ♦ | Dice Number 8 |
| Q ♣ | 10 ♦ | 8 ♠ | 6 ♥ | 2 ♣ | JOKER | Dice Number 9 |

Figure 1

SYSTEM AND METHOD FOR PLAYING A DICE GAME APPROXIMATING A CARD GAME

FIELD OF THE INVENTION

The present invention relates to the field of dice games. More particularly, the present invention relates to a system and method for playing a dice game approximating a playing card game.

BACKGROUND OF THE INVENTION

Dice have often been used as a gaming tool. Dice games take many forms, including both those where the dice are elements of a stand-alone dice game and others where, for example, the dice are one element supplementing a game consisting of many elements.

Poker-related dice games have been known for some time, and often feature dice incorporating design markings similar to those used on and in connection with playing cards. The design markings may include suit markings (such as, for example, spades and diamonds) and/or value markings (such as, for example, aces, jacks, and the joker). The term "poker dice" is commonly used to refer to dice incorporating such markings.

A limitation of known poker-related dice games is the inability to efficiently design dice that, when rolled, may produce all of the common poker hands (high card, pair, two pair, three of a kind, straight, flush, full house, four of a kind, straight flush, royal flush). Inventors have long recognized the need for such dice. U.S. Pat. No. 3,608,905 to Edison (1971) disclosed five dodecahedral (ten-sided) dice capable of producing a straight flush when rolled, but could not produce all of the common poker hands. In addition, U.S. Pat. No. 4,989,875 to Capy (1991) discloses octahedral (eight-sided) dice capable of producing a straight flush when rolled, but could not produce all of the common poker hands. In addition, neither Edison nor Capy utilized six-sided dice.

The inability to efficiently design dice that may produce all of the common poker hands has limited the popularity of poker-related dice games. U.S. Pat. No. 5,125,660 to Stahl discloses a chart that shows the fall off in entertainment value of poker-related dice games as the number of sides of the dice used in the game is increased.

Accordingly, it is an object of this invention to provide a poker-related dice game that may produce all of the common poker hands (high card, pair, two pair, three of a kind, straight, flush, full house, four of a kind, straight flush, royal flush) in an efficient manner using six-sided dice.

A further limitation of known poker-related dice games is the inability to efficiently incorporate wildcards into the dice and gameplay. A wildcard, such as a joker, can enhance gameplay by, for example, allowing a player to hold five cards of the same value (i.e., five of a kind), or introducing additional variables or twists.

Accordingly, it is a further object of this invention to provide a poker-related dice game that may efficiently incorporate wildcards into the dice design to enhance the gameplay of the poker-related dice game.

Additional objects and advantages will become apparent upon consideration of the full disclosure herein.

SUMMARY OF THE INVENTION

According to certain preferred embodiments of the present invention, poker dice are provided. According to additional certain preferred embodiments of the present invention, methods for playing a poker game using the poker dice and a deck of standard playing cards are also provided.

According to one aspect of the invention poker dice are provided, comprising a set of six-sided poker dice wherein on any given roll the six-sided poker dice may produce any of the common poker hands.

According to another aspect of the invention, poker dice are provided wherein the set of six-sided poker dice comprises nine poker dice.

According to another aspect of the invention, poker dice are provided wherein the set of six-sided poker dice comprises: (a) a first poker die with value markings and suit markings of ace of diamonds, three of spades, four of hearts, five of clubs, six of diamonds, and jack of spades; (b) a second poker die with value markings and suit markings of ace of spades, four of diamonds, three of clubs, nine of diamonds, six of spades, and jack of hearts; (c) a third poker die with value markings and suit markings of ace of hearts, four of spades, seven of hearts, six of clubs, eight of diamonds, and joker; (d) a fourth poker dice with value markings and suit markings of ace of clubs, three of hearts, seven of spades, five of diamonds, nine of clubs, and jack of diamonds; (e) a fifth poker dice with value markings and suit markings of king of diamonds, two of spades, four of clubs, nine of spades, ten of clubs, and queen of hearts; (f) a sixth poker die with value markings and suit markings of king of clubs, queen of spades, nine of hearts, seven of clubs, five of spades, and three of diamonds; (g) a seventh poker die with value markings and suit markings of king of hearts, two of hearts, ten of spades, eight of hearts, seven of diamonds, and jack of clubs; (h) an eighth poker die with value markings and suit markings of king of spades, queen of diamonds, ten of hearts, eight of clubs, five of hearts, and two of diamonds; and (i) a ninth poker die with value markings and suit markings of queen of clubs, ten of diamonds, eight of spades, six of hearts, two of clubs, and joker.

According to another aspect of the invention, poker dice are provided wherein the set of six-sided poker dice has at least one poker die with at least one value marking displayed by a character symbol, character symbols, a design symbol, or design symbols.

According to another aspect of the invention, poker dice are provided wherein the set of six-sided poker dice has at least one poker die with at least one suit marking displayed by at least one of the symbols ♠, ♣, ♦, and ♥.

According to another aspect of the invention, poker dice are provided wherein the set of six-sided poker dice has at least one poker die with a wildcard value marking. According to yet another aspect of the invention, the wildcard value marking may be displayed by a character symbol, character symbols, a design symbol, or design symbols.

According to one aspect of the invention a method of gameplay using poker dice is provided, comprising the steps of: (a) selecting a dealer; (b) each player making an ante wager; (c) rolling a set of six-sided poker dice wherein on any given roll the six-sided poker dice may produce any of the common poker hands; and (d) each player at least once electing to bet, pass, or fold.

According to one aspect of the invention a method of gameplay using poker dice and playing cards is provided, comprising the steps of: (a) selecting a dealer; (b) the dealer dealing a first playing card to each player; (c) the dealer dealing a second playing card to each player; (d) each player at least once electing to bet, pass, or fold; (e) one player rolling a set of poker dice; (f) said one player selecting at least one poker die from the set of poker dice as a community card available for all players to use to make a poker hand; and (g) repeating steps (d) through (f) until play of the hand is complete.

According to another aspect of the invention a method of gameplay using poker dice and playing cards is provided, wherein at least five common poker dice are selected as community cards available for all players to use to make a poker hand.

According to another aspect of the invention a method of gameplay using poker dice and playing cards is provided, wherein after at least one poker die is selected as a community card available for all players to use to make a poker hand, that at least one common poker die can no longer be rolled as part of the set of poker dice.

According to another aspect of the invention a method of gameplay using poker dice and playing cards is provided, wherein the method comprises the additional step of determining whether at least one value marking of at least one poker die of the set of poker dice will be treated as a wildcard value marking.

According to another aspect of the invention a method of gameplay using poker dice and playing cards is provided, wherein, after the first roll of the set of poker dice, the one player selects at least three poker die from the set of poker dice as community cards available for all players to use to make a poker hand.

According to yet another aspect of the invention a method of gameplay using poker dice and playing cards is provided, wherein, after the second roll of the set of poker dice, the one player selects at least one poker die from the set of poker dice as a community card available for all players to use to make a poker hand.

According to yet another aspect of the invention a method of gameplay using poker dice and playing cards is provided, wherein, after the third roll of the set of poker dice, the one player selects at least one poker die from the set of poker dice as a community card available for all players to use to make a poker hand.

According to another aspect of the invention a method of gameplay using poker dice and playing cards is provided, wherein the set of poker dice comprises a set of six-sided poker dice wherein on any given roll the six-sided poker dice may produce any of the common poker hands.

According to yet another aspect of the invention a method of gameplay using poker dice and playing cards is provided, wherein the set of six-sided poker dice comprises nine poker dice.

According to yet another aspect of the invention a method of gameplay using poker dice and playing cards is provided, wherein the set of six-sided poker dice comprises: (a) a first poker die with value markings and suit markings of ace of diamonds, three of spades, four of hearts, five of clubs, six of diamonds, and jack of spades; (b) a second poker die with value markings and suit markings of ace of spades, four of diamonds, three of clubs, nine of diamonds, six of spades, and jack of hearts; (c) a third poker die with value markings and suit markings of ace of hearts, four of spades, seven of hearts, six of clubs, eight of diamonds, and joker; (d) a fourth poker dice with value markings and suit markings of ace of clubs, three of hearts, seven of spades, five of diamonds, nine of clubs, and jack of diamonds; (e) a fifth poker dice with value markings and suit markings of king of diamonds, two of spades, four of clubs, nine of spades, ten of clubs, and queen of hearts; (f) a sixth poker die with value markings and suit markings of king of clubs, queen of spades, nine of hearts, seven of clubs, five of spades, and three of diamonds; (g) a seventh poker die with value markings and suit markings of king of hearts, two of hearts, ten of spades, eight of hearts, seven of diamonds, and jack of clubs; (h) an eighth poker die with value markings and suit markings of king of spades, queen of diamonds, ten of hearts, eight of clubs, five of hearts, and two of diamonds; and (i) a ninth poker die with value markings and suit markings of queen of clubs, ten of diamonds, eight of spades, six of hearts, two of clubs, and joker.

As described in more detail below, the poker dice and methods are useful for (i) allowing game participants to roll all of the common poker hands (high card, pair, two pair, three of a kind, straight, flush, full house, four of a kind, straight flush, royal flush), in an efficient manner, (ii) enhancing the gameplay of the poker-related dice game by using six-sided dice, (iii) enhancing the gameplay of the poker-related dice game by incorporating wildcards into the poker dice system, and (iv) additional advantages that will become apparent upon consideration of the full disclosure herein.

The above-mentioned and additional features of the present invention are further illustrated in the Detailed Description contained herein.

BRIEF DESCRIPTION OF THE FIGURES

FIG. 1 shows a representation of poker dice of the present invention.

DETAILED DESCRIPTION OF THE INVENTION

Figure 2:
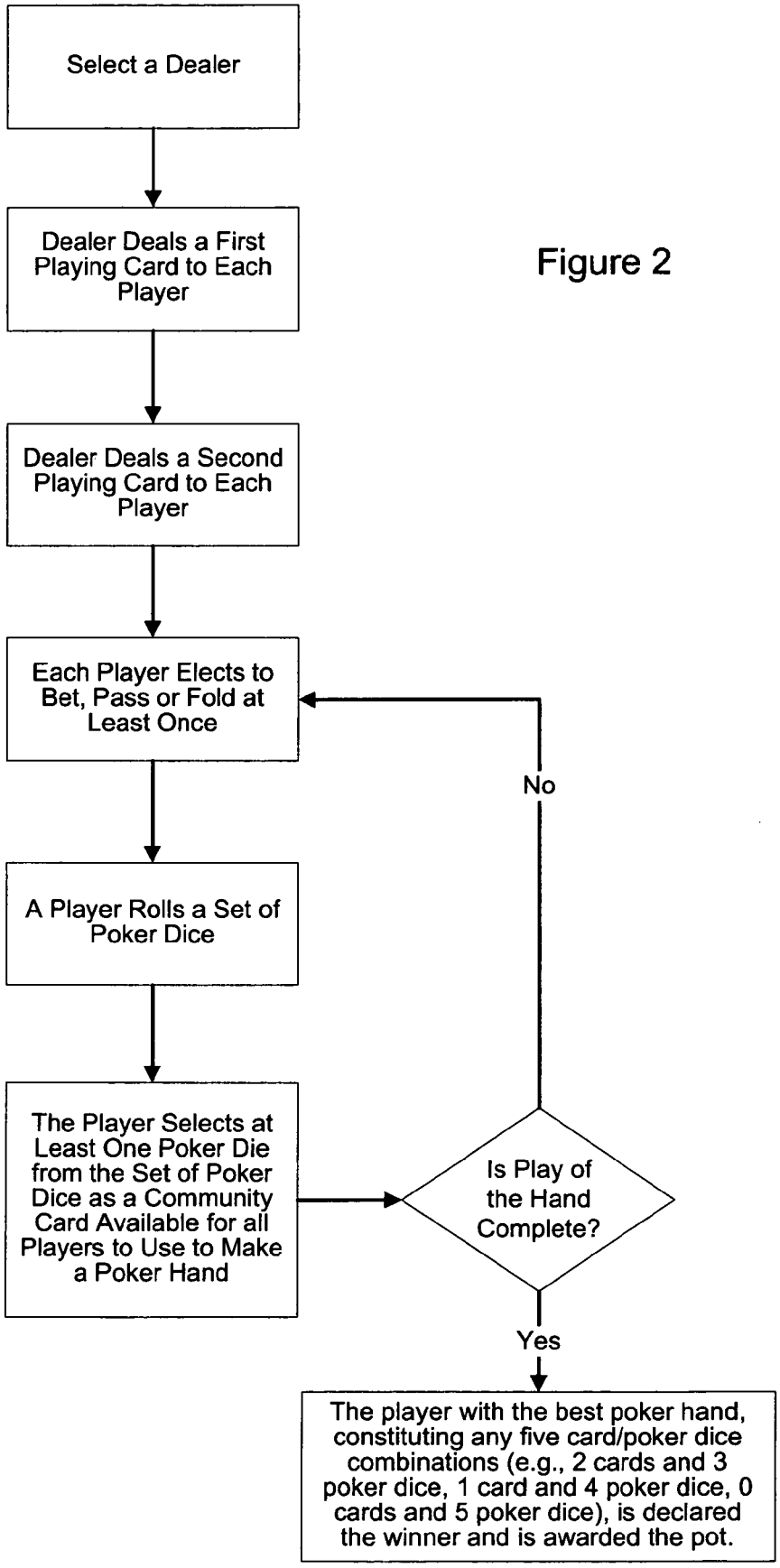
FIG. 2 shows a flowchart illustrating the gameplay of a method of the present invention.

The following will describe in detail several preferred embodiments of the present invention. These embodiments are provided by way of explanation only and, thus, should not unduly restrict the scope of the invention. In fact, those of ordinary skill in the art will appreciate upon reading the present specification and viewing the present drawings that the invention teaches variations and modifications, and that such variations and modifications of the invention may be employed, used, and made without departing from the scope and spirit of the invention.

According to certain preferred embodiments of the present invention, poker dice are provided. The poker dice consist of nine dice, each of which is a six-sided die. The nine dice may be marked with suit markings including spades, clubs, diamonds and hearts, which are symbolically shown as ♠, ♣, ♦, and ♥.

The nine dice may also be marked with value markings including face-card markings such as, for example, markings denoting aces, kings, queens, and jacks. The value markings for face-cards may be represented in many ways, including with character symbols (e.g., A for ace, K for king, Q for queen, J for jack) or design symbols (e.g., an image of a king for the king; various characters from a television show representing the ace, king, queen, and jack).

Additional value markings include markings for denoting non-face cards, which are numbered two through ten. These additional value markings may be represented in many ways, including using character symbols (e.g., 2, 3, 4, 5, 6, 7, 8, 9, 10; two, three, four, five, six, seven, eight, nine, ten) or design symbols (e.g., a number of dots or other design symbols equal to the number value of each dice). A further value marking represents a wildcard, commonly a "joker" card often found in a deck of standard playing cards. This wildcard value marking may be represented in many ways, including character symbols (e.g., the word "joker", the word "wildcard") or design symbols (e.g., an image of a joker; a character from a television show representing the joker or wildcard).

FIG. 1 illustrates an embodiment of poker dice of the present invention including both suit markings and value markings. The chart below also reflects an arrangement of the suit markings and value markings of an embodiment of poker dice of the present invention.

| Dice Number | Side 1 | Side 2 | Side 3 | Side 4 | Side 5 | Side 6 |
|---|---|---|---|---|---|---|
| 1 | A ♦ | 3 ♠ | 4 ♥ | 5 ♣ | 6 ♦ | J ♠ |
| 2 | A ♠ | 4 ♦ | 3 ♣ | 9 ♦ | 6 ♠ | J ♥ |
| 3 | A ♥ | 4 ♠ | 7 ♥ | 6 ♣ | 8 ♦ | Joker |
| 4 | A ♣ | 3 ♥ | 7 ♠ | 5 ♦ | 9 ♣ | J ♦ |
| 5 | K ♦ | 2 ♠ | 4 ♣ | 9 ♠ | 10 ♣ | Q ♥ |
| 6 | K ♣ | Q ♠ | 9 ♥ | 7 ♣ | 5 ♠ | 3 ♦ |
| 7 | K ♥ | 2 ♥ | 10 ♠ | 8 ♥ | 7 ♦ | J ♣ |
| 8 | K ♠ | Q ♦ | 10 ♥ | 8 ♣ | 5 ♥ | 2 ♦ |
| 9 | Q ♣ | 10 ♦ | 8 ♠ | 6 ♥ | 2 ♣ | Joker |

The poker dice illustrated in FIG. 1 and described in the chart above, on any given roll, may produce any of the common poker hands (high card, pair, two pair, three of a kind, straight, flush, full house, four of a kind, straight flush, royal flush). It is also appreciated by those skilled in the art that variations on the poker dice illustrated in FIG. 1 and described in the chart above may also achieve the same result.

Methods of using the poker dice described and claimed herein, with or without a deck of standard playing cards, can approximate a gameplay similar to the Texas Hold 'Em poker game. The first step in the method is selecting a dealer for the game by, for example, drawing from a deck of standard playing cards. The participant who draws the highest card is selected as the dealer. A roll of the poker dice could also be used to select the dealer with, for example, the participant rolling the best poker hand being selected as the dealer.

Once a dealer is selected, each participant makes a wager, known as the ante, that signals that participant's willingness to play the game. This wager is a fixed amount and may be placed, for example, in the center of the table. The amount of the ante may vary, from a relatively small amount of approximately $0.10 in a casual game to a relatively high amount in excess of $100.00 in a competitive game. Alternatively, token betting chips may be used. The collection of wagers, ante wagers and otherwise, is known as the pot.

Then, after each participant has made an ante wager, the dealer deals two cards from the standard deck of playing cards to each player. The dealer may deal the cards in any manner acceptable to the players, however, a common method of dealing includes (a) beginning the dealing with the player to the dealer's left, (b) dealing one card face down to each player, and (c) then dealing another card face down to each player.

If the standard deck of playing cards includes jokers, the dealer then announces if the jokers are wild. For example, if the jokers are wild then the value of that joker can be selected by each player holding a joker card. If the jokers are not wild then each joker card has no value. The dealer may also announce if a different value marking or another value marking will be considered to be a wildcard for that game.

Following the wildcard announcement, each player elects whether to bet, pass, or fold. The first player to make this election is the player to the dealer's left, and then each player follows in clockwise succession. If the first player elects to bet, then that player determines an amount to add to the pot and adds that amount. A fixed maximum bet may be set at the outset of the game, or the game may be played in the "no limit" format where there is no fixed maximum bet. If the first player elects to pass, then that player adds no amount to the pot but is allowed to remain in the game. If the first player elects to fold, then that player places the two previously dealt cards face down and is out of the game.

The remaining players, in clockwise succession, then each elect whether to bet, pass, or fold. If any preceding player has elected to bet, then each remaining player cannot pass and must either call the bet, raise the bet, or fold. A player calls a preceding bet by matching the amount of the preceding bet previously added to the pot. A player raises a preceding bet by matching and adding to the amount of the preceding bet previously added to the pot. If any player raises a preceding and existing bet then, after each player has had one opportunity to bet, pass, or fold, the player(s) whose preceding bets were subsequently raised must elect to call the raise (by matching the amount of the raise previously added to the pot) or fold. Each player who folds (by election, by not matching a raise, or by other means) places the two previously dealt cards face down and is out of the game.

After each player has elected whether to whether to bet, pass, or fold, the player to the dealer's left rolls all nine of the poker dice. The player may roll the poker dice by hand, or may use a cup, mug, or other auxiliary rolling device to aid in making the roll. That player then selects at least one of the rolled poker dice and places it in a location where its rolled value can be observed by each player (e.g., in the middle of the playing table). In some instances, the selected poker die may immediately bolster the rolling player's hand (e.g., allowing the rolling player to pair a card with a face-card marking of king with a die with a face-card marking of king to create a pair). In other instances, the selected poker die may not immediately bolster the rolling player's hand (e.g., giving the rolling player an opportunity to later create a flush by first selecting a die with a suit marking matching the suit markings of the two cards in that player's hand). This selected poker die is a common die or community card whose value marking and/or suit marking may be used by each player to create the best available poker hand.

Depending on the nature of the game being played, the rolling player may select any number of the rolled poker dice as common dice or community cards. For example, in a game approximating a gameplay similar to the Texas Hold 'Em poker game: (i) the first rolling player may select three of the rolled poker dice as common dice or community cards which, in the Texas Hold 'Em poker game, are commonly referred to as the "flop"; (ii) the second rolling player may select one of the rolled poker dice as common dice or community cards which, in the Texas Hold 'Em poker game, is commonly referred to as the "turn"; and (iii) the third rolling player may select one of the rolled poker dice as common dice or community cards which, in the Texas. Hold 'Em poker game, is commonly referred to as the "river".

Following the roll of the nine poker dice, each player again elects whether to bet, pass, or fold. This election process occurs again using the same rules as previously described.

After each player has again elected whether to bet, pass, or fold, the next successive player rolls the remaining eight poker dice. That rolling player then selects one of the eight rolled poker dice in the manner previously described for selecting one of the nine rolled poker dice. Each player then again elects whether to bet, pass, or fold using the same rules as previously described. This rolling, selection, and bet/pass/fold process is repeated until there are five common poker dice.

After the fifth common poker die is selected, each player makes a final election of whether to bet, pass, or fold. This final election proceeds using the same rules as previously described.

After the last player elects whether to bet, pass, or fold, that same player calls the first player to his/her left. When called, that player must turn over the two cards in that player's hand to reveal those cards' suit markings and value markings. All players then successively reveal their hands in a similar manner. The player with the best poker hand, constituting any five card/poker dice combination (e.g., 2 cards and 3 poker dice, 1 card and 4 poker dice, 0 cards and 5 poker dice), is declared the winner and is awarded the pot.

The players may then elect to continue playing, in which case a new dealer is selected and the game begins again with another round of ante wagers by those who wish to be players in the game.

Various modifications to the gameplay described above are now described.

One variation of the gameplay described above concerns a player that elects to fold after rolling the poker dice. In this variation, the player to the left of the rolling and folding player selects a common poker die from the existing set of rolled poker dice. The player to the left of the rolling and folding player does not get to roll the poker dice.

Another variation of the gameplay described above concerns the treatment of a poker die displaying a wildcard value marking. If a player rolls the poker dice and a poker die displaying a wildcard value marking is displayed, that player may elect to keep the poker die displaying a wildcard value marking as a private wildcard/poker die for use by only that player. In addition, that player may also or alternatively elect to remove one poker die from the collection of common poker die.

Another variation of the gameplay described above is to use the poker dice in connection with a game other than the Texas Hold 'Em poker game. For example, the poker dice could be used to enhance the gameplay of various other poker games such as stud, draw, Omaha, Razz, Horse, and other poker games.

While there have been shown and described fundamental features of the invention as applied to preferred embodiments thereof, it will be understood that various omissions and substitutions and changes in the form and details of the methods and compositions illustrated and/or described herein, and in their operation, may be made by those of ordinary skill in the art without departing from the spirit of the invention. For example, it is expressly intended that all combinations of those elements and/or method steps which perform substantially the same function in substantially the same way to achieve the same results are within the scope of the invention.

I claim:

1. Poker dice, comprising a set of six-sided poker dice wherein all 54 cards of a standard playing deck are represented on the set of six-sided poker dice and value markings and suit markings of all of the 54 cards of the standard playing deck are arranged on the poker dice wherein on any given roll the six-sided dice may produce any of the common poker hands including hands chosen from the set of all four of a kind and all straight flushes.

2. The poker dice of claim 1, wherein the set of six sided poker dice comprises nine poker dice.

3. The poker dice of claim 1, wherein the set of six-sided poker dice comprises:

(a) a first poker die with value markings and suit markings of ace of diamonds, three of spades, four of hearts, five of clubs, six of diamonds, and jack of spades;

(b) a second poker die with value markings and suit markings of ace of spades, four of diamonds, three of clubs, nine of diamonds, six of spades, and jack of hearts;

(c) a third poker die with value markings and suit markings of ace of hearts, four of spades, seven of hearts, six of clubs, eight of diamonds and joker;

(d) a fourth poker dice with value markings and suit markings of ace of clubs, three of hearts, seven of spades, five of diamonds, nine of clubs and jack of diamonds;

(e) a fifth poker dice with value markings and suit markings of king of diamonds, two of spades, four of clubs, nine of spades, ten of clubs, and queen of hearts;

(f) a sixth poker die with value markings and suit markings of king of clubs, queen of spades, nine of hearts, seven of clubs, five of spades, and three of diamonds;

(g) a seventh poker die with value markings and suit markings of king of hearts, two of hearts, ten of spades, eight of hearts, seven of diamonds, and jack of clubs;

(h) an eighth poker die with value markings and suit markings of king of spades, queen of diamonds, ten of hearts, eight of clubs, five of hearts, and two of diamonds; and (i) a ninth poker die with value markings and suit markings of queen of clubs, ten of diamonds, eight of spades, six of hearts, two of clubs and joker.

4. The poker dice of claim one, wherein the set of six-sided poker dice have value markings and character markings such that:

(a) a die having an ace of a suit chosen from the set of suits club, spade, heart and diamond, will not contain a value on its remaining five sides chosen from the set of values king, queen, jack, ten, two, three, four and five, of the same suit;

(b) a die having a king of a suit chosen from the set of suits club, spade, heart and diamond, will not contain a value on its remaining 5 sides chosen from the set of values queen, jack, ten, nine, of the same suit;

(c) a die having a queen of a suit chosen from the set of suits club, spade, heart and diamond, will not contain a value on its remaining 5 sides chosen from the set of values jack, ten, nine, eight, of the same suit;

(d) a die having a jack of a suit chosen from the set of suits club, spade, heart and diamond, will not contain a value on its remaining 5 sides chosen from the set of values ten, nine, eight, seven of the same suit;

(e) a die having a ten of a suit chosen from the set of suits club, spade, heart and diamond, will not contain a value on its remaining 5 sides chosen from the set of values nine, eight, seven, six of the same suit;

(f) a die having a nine of a suit chosen from the set of suits club, spade, heart and diamond, will not contain a value on its remaining 5 sides chosen from the set of values eight, seven, six, five of the same suit;

(g) a die having an eight of a suit chosen from the set of suits club, spade, heart and diamond, will not contain a value on its remaining 5 sides chosen from the set of values seven, six, five, four of the same suit;

(h) a die having a seven of a suit chosen from the set of suits club, spade, heart and diamond, will not contain a value on its remaining 5 sides chosen from the set of values six, five, four, three of the same suit; and (i) a die having a six of a suit chosen from the set of suits club, spade, heart and diamond, will not contain a value on its remaining 5 sides chosen from the set of values five, four, three, two of the same suit.

5. The poker dice of claim one, wherein the set of six-sided poker dice have value markings and character markings such that;

(a) a die having an ace of a suit chosen from the suits spade, club, heart and diamond will contain no more than one additional value from the same suit chosen from the set of values six, seven, eight and nine;

(b) a die having a king of a suit chosen from the suits spade, club, heart and diamond will contain no more than two additional values from the same suit chosen from the set of values eight, seven, six, five, four, three and two;

(c) a die having a queen of a suit chosen from the suits spade, club, heart and diamond will contain no more than two additional values from the same suit chosen from the set of values seven, six, five, four, three and two;

(d) a die having a jack of a suit chosen from the suits spade, club, heart and diamond will contain no more than two additional values from the same suit chosen from the set of values six, five, four, three and two;

(e) a die having a ten of a suit chosen from the suits spade, club, heart and diamond will contain, from the same suit, no more than two additional values chosen from the set of values five, four, three and two;

(f) a die having a nine of a suit chosen from the suits spade, club, heart and diamond will contain, from the same suit, no more than two additional values chosen from the set of values ace, four, three and two;

(g) a die having a eight of a suit chosen from the suits spade, club, heart and diamond will contain, from the same suit, no more than two additional values chosen from the set of values ace, king, three and two;

(h) a die having a seven of a suit chosen from the suits spade, club, heart and diamond will contain, from the same suit, no more than two additional values chosen from the set of values ace, king, queen and two.

6. The poker dice of claim one, wherein the set of six-sided poker dice wherein:

a first die will have the ace of a first suit and the first die will not have the king, queen, jack, ten, five, four, three or two of the first suit and the first die will have one and only one value chosen from the nine, eight, seven and six of the first suit;

a second die will have a king of a second suit and the second die will not have the ace, queen, jack, ten, or nine of the second suit and the second die will have at least one and not more than two values chosen from the eight, seven, six, five, four, three and two of the second suit.

7. The poker dice of claim one, wherein the set of six-poker dice has at least one poker die with at least one value marking displayed by design symbols.

8. The poker dice of claim one, wherein the set of six-sided poker dice has at least one poker die with a wildcard value marking.

9. The poker dice of claim 8, wherein the wildcard value marking is displayed by a character symbol.

10. The poker dice of claim 8, wherein the wildcard value marking is displayed by a character symbol.

11. The poker dice of claim 8, wherein the wildcard value marking is displayed by a design symbol.

12. The poker dice of claim 8, wherein the wildcard value marking is displayed by a design symbols.

* * * * *